United States Patent [19]

Carey

[11] Patent Number: 4,687,209

[45] Date of Patent: Aug. 18, 1987

[54] SOCCER TRAINING BALL ASSEMBLY

[76] Inventor: Robert G. Carey, 2323 N. Merrily Cir., Seffner, Fla. 33584

[21] Appl. No.: 914,916

[22] Filed: Oct. 3, 1986

[51] Int. Cl.[4] ..... A63B 43/00; A63B 69/26

[52] U.S. Cl. ..... 273/411; 273/58 C; 273/414; 273/DIG. 19

[58] Field of Search ..... 273/414, 411, 58 C, 273/DIG. 19

[56] References Cited

U.S. PATENT DOCUMENTS

| | | | |
|---|---|---|---|
| 1,582,983 | 5/1926 | Hamblet | 273/58 C |
| 2,864,617 | 12/1958 | Crowley et al. | 273/58 C |
| 2,894,746 | 7/1959 | Chupa | 273/58 B X |
| 2,948,532 | 8/1960 | Jepsen | 273/58 C |
| 4,021,035 | 5/1977 | O'Hara | 273/DIG. 19 X |
| 4,071,241 | 1/1978 | Cortes Garcia | 273/414 X |
| 4,121,829 | 10/1978 | Petrusek | 273/414 |
| 4,248,423 | 2/1981 | Lotfy | 273/58 C |
| 4,272,076 | 6/1981 | Song et al. | 273/58 C |

*Primary Examiner*—William H. Grieb

*Attorney, Agent, or Firm*—Herbert W. Larson; Joseph C. Mason, Jr.

[57] ABSTRACT

A captive soccer ball is attached to the waist of a player by means of a multi-component tether. The tether has a first elastic member threaded through a reinforced channel through the surface of the ball. The first elastic member is attached to a nylon cord which in turn is attached to a second elastic member. This latter elastic member is attached to a waist band around the player.

5 Claims, 5 Drawing Figures

SOCCER TRAINING BALL ASSEMBLY

TECHNICAL FIELD

This invention relates to kickable balls attached to a tether. More specifically, it refers to a soccer ball with a channel for receiving a first end of a multiple component tether.

BACKGROUND ART

It is known from U.S. Pat. No. 2,948,532 to insert a channel in an ordinary gas-filled, resilient rubber ball to fasten a tether. This channel is reinforced with a polyvinylchloride tube with one end expanded by a small steel ball. The insertion of a polyvinylchloride tube into a soccer ball is not practical since such a device will have a detrimental effect on the bounce of the ball.

It is known from U.S. Pat. No. 4,121,829 that a tether can be attached to an inflatable ball at one end and the body of a player at another end. However, the ball employed in this description has a reinforcing patch with eyelet attached to the ball and this impedes proper action of the ball when kicked. Other tether ball assemblies are set forth in U.S. Pat. Nos. 2,864,617; 2,894,746; 4,248,423; and 4,272,076. In all these descriptions the ball is hindered from its true bounce by the specific attaching means employed.

Soccer has become one of the fastest growing sports in the United States within the last ten years and young people are training in high schools and colleges to perfect their skills. A soccer training ball is needed that will bounce true and have sufficient strength to prevent rupture of its means for attachment to a tether.

SUMMARY OF THE INVENTION

I have solved the problem discussed above with a soccer ball tether assembly that permits many hours of active play without damaging the soccer ball and at the same time providing a true bounce to the ball to resemble game conditions.

My invention comprises a captive soccer ball, a multi-component tether attached at one end to the ball and at its other end to the waist of the player for ease of ball retrieval after it is struck by the player. The ball has a unique, high-strength mounting channel for securing the first end of the tether. This channel projects through the elastomeric surface of the ball and under a canvas interliner that is vulcanized to a nylon wound material surrounding the ball's bladder.

BRIEF DESCRIPTION OF THE DRAWINGS

The present invention may be best understood by those of ordinary skill in the art by reference to the following detailed description when considered in conjunction with the accompanying drawings in which.

DESCRIPTION OF THE PREFERRED EMBODIMENT

Figure 2:
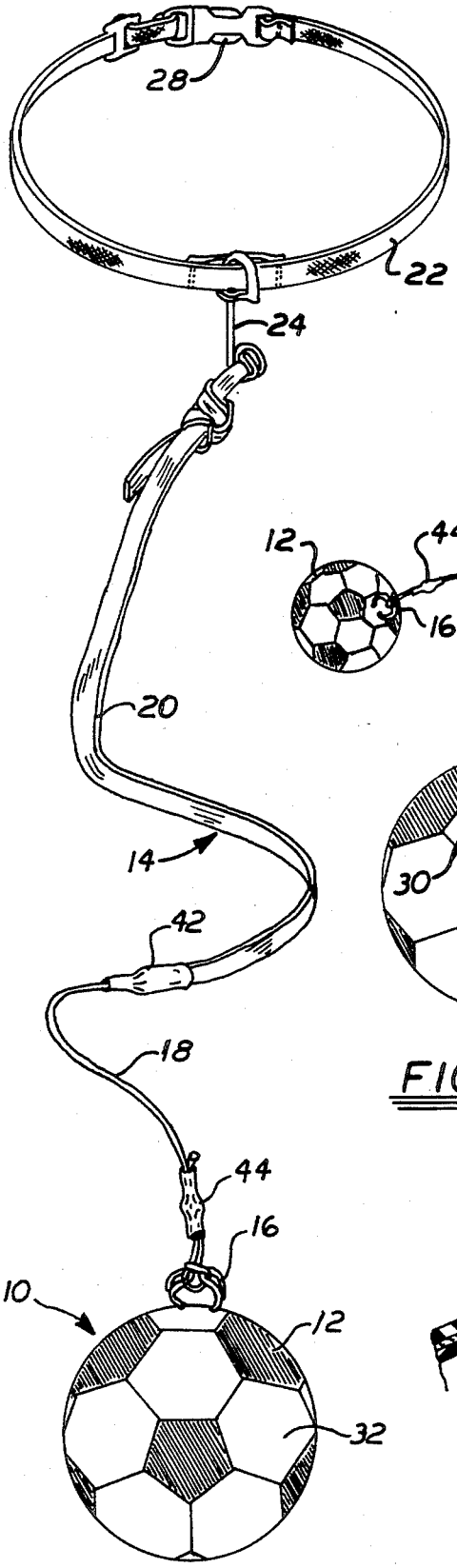
FIG. 2 is an enlarged perspective view of the soccer training ball assembly.
Figure 1:
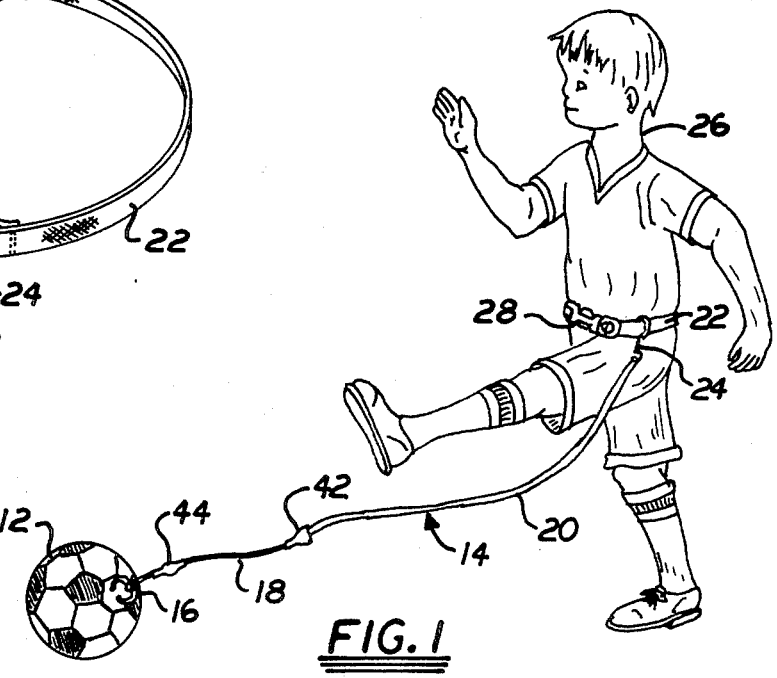
FIG. 1 is a perspective view of a child using the soccer training ball assembly.

Referring now to the drawings in which like reference characters designate like or corresponding parts throughout the several views, there is shown in FIG. 1 a child 26 kicking the soccer ball 12 fastened to its tether 14. The assembly 10 is shown specifically in FIG. 2 with tether 14. The tether 14 is made up of three members. The first is an elastic member 16 (also described as a first elastic member) looped through channel 30 in ball 12, and tied to a second member which is a high strength cord 18 made out of nylon or other natural or synthetic braided material.

The cord 18 is tied to the third member which is an elongated elastic member 20. The third member, also described as the second elastic member, is attached to the waist band 22 by waist swivel clip 24. The waist band is held together by clasp 28.

Figure 4:
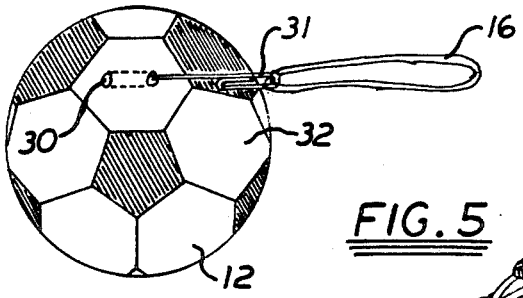
FIG. 4 is a perspective view of a soccer ball showing how the tether is inserted into the channel of the ball.
Figure 5:
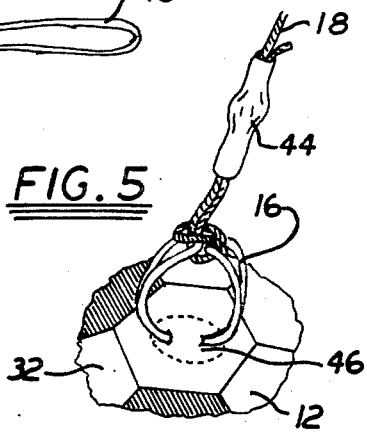
FIG. 5 is an enlarged view of the channel section of the ball together with a portion of the tether threaded through the channel.
Figure 3:
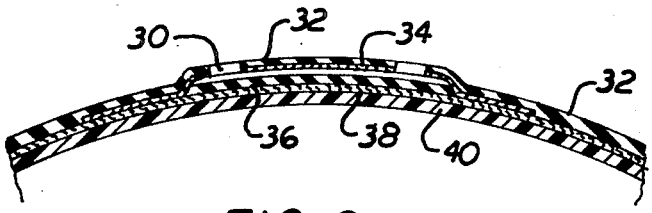
FIG. 3 is a partial cross sectioned view of the soccer ball showing the strengthened channel.

The ball 12 has an outer elastomeric layer 32 penetrated by channel 30. Channel 30 receives the first elastomeric member 16 of the tether 14 as shown in FIG. 4. A paper clip 31 can be used to thread the elastomeric member 16 into channel 30. This first elastomeric member 16 is looped around and engaged to the cord 18 as shown in FIG. 5. An attaching device 44 holds the end of the cord 18 to prevent slippage.

The cord 18 is attached to the second elastomeric member 20 by attaching device 42. The second elastomeric member 20 is attached to waist band 22 using waist swivel clip 24.

The first elastomeric member 16 is securely held in channel 30 because of the construction of a channel patch 46 which preserves the integrity of the ball's structure while still allowing the ball 12 to bounce in a normal fashion. The patch 46 is made by inserting a canvas layer 34 interior to the outer elastomeric layer 32 of the ball 12. The canvas layer 34 penetrates a second elastomeric layer 36 interior to the first elastomeric layer 32 and is vulcanized to an interior synthetic fiber layer 38. This fiber layer is usually nylon but can also be made from other high strength synthetic fibers. The fiber layer is vulcanized to the elastomeric bladder 40 surrounding the interior air chamber of ball 12.

The complete assembly provides an excellent coaches tool, enabling team drills for eye-foot coordination, trapping the ball, body control of the ball, throw in and heading shots on a goal or goal keeper distribution and handling.

Modifications and equivalent devices can be employed for the above described assembly without departing from my invention.

Having thus described the invention, what is claimed as new and desired to be secured by Letters Patent is:

1. A soccer ball assembly for practice purposes comprising:

(a) a captive soccer ball;

(b) a tether attached at a first end through a mounting channel in the soccer ball and at a second end to the waist of a player;

(c) the mounting channel having an opening at each end in the surface of the soccer ball, the channel projecting downwardly into the soccer ball through a first elastomeric layer and a canvas layer located as a patch below the first elastomeric layer of the ball, the canvas being of sufficient diameter to enclose the outer dimension of the channel, the canvas layer passing through holes in a second elastomeric layer interior to the first elastomeric layer and the canvas layer attaching by vulcanization to a synthetic fabric layer surrounding an interior bladder of the ball.

2. A soccer ball assembly according to claim 1, wherein the tether has a first elastic member at its first end threaded through the channel and a body waist harness at its second end with a non-elastic cord attached at a first end to the first elastic member at a point furthest from the ball and the non-elastic cord attached at a second end to a high strength second elastic member at its second end, the second elastic member being attached to the waist harness at its end furthest from the non-elastic cord.

3. A soccer ball assembly according to claim 1 wherein the synthetic fabric layer is nylon.

4. A soccer ball assembly according to claim 2 wherein the non-elastic cord is braided nylon.

5. A soccer ball assembly according to claim 2 wherein the non-elastic cord is a braided natural fiber.

* * * * *